US012209334B2

(12) United States Patent
Myogi et al.

(10) Patent No.: US 12,209,334 B2
(45) Date of Patent: Jan. 28, 2025

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 0 days.

(21) Appl. No.: 17/699,880

(22) Filed: Mar. 21, 2022

(65) Prior Publication Data

US 2022/0356612 A1 Nov. 10, 2022

(30) Foreign Application Priority Data

May 6, 2021 (JP) ..... 2021-078587

(51) Int. Cl.
*D03D 49/02* (2006.01)
*D03D 49/00* (2006.01)

(52) U.S. Cl.
CPC ..... *D03D 49/02* (2013.01)

(58) Field of Classification Search
CPC ..... D03D 49/02; D03D 51/02; D03D 49/10; D03D 49/62
See application file for complete search history.

(56) References Cited

U.S. PATENT DOCUMENTS 453,467 A * 6/1891 Elles et al. ..... D03D 49/52 139/184
463,815 A * 11/1891 Parks ..... B21F 29/02 140/35
479,358 A * 7/1892 Foster ..... D02H 13/00 28/212
517,058 A * 3/1894 Parks et al. ..... B27J 1/006 242/153
526,365 A * 9/1894 Gledhill ..... D03C 3/20 139/62

(Continued)

FOREIGN PATENT DOCUMENTS

BE 1010848 A6 2/1999
JP S62-133150 A 6/1987

(Continued)

OTHER PUBLICATIONS

Oct. 6, 2022, European Search Report issued for related EP Application No. 22163844.8.

*Primary Examiner* — Robert H Muromoto, Jr.
(74) *Attorney, Agent, or Firm* — Paratus Law Group, PLLC

(57) ABSTRACT

A loom includes a pair of side frames configured to support a beating device and each having a beam support configured to support a warp beam; and a drive mechanism configured to rotationally drive the warp beam including a beam gear, where each of the side frames is configured by a main body frame configured to support the beating device and a let-off frame fixed to the main body frame and configured to support the beam support. The drive mechanism is attached to the main body frame.

1 Claim, 6 Drawing Sheets

(56) References Cited

U.S. PATENT DOCUMENTS 549,716 A * 11/1895 Geoghegan et al. .. D03D 51/00 139/156
643,657 A * 2/1900 King ..... D03D 49/20 139/308
714,294 A * 11/1902 Gable ..... D03D 49/46 139/141
2,219,771 A * 10/1940 Foster, V ..... D03C 3/24 139/59
3,282,543 A * 11/1966 Engels ..... D03D 49/025 248/677
4,284,176 A * 8/1981 Haraikawa ..... F16D 65/567 188/72.3
4,664,156 A * 5/1987 Breyer ..... D03D 49/00 139/1 R
8,104,377 B2 * 1/2012 Nakamura ..... B23Q 16/025 74/813 R
8,449,232 B2 * 5/2013 Tatsuda ..... B23Q 16/102 192/225
8,449,233 B2 * 5/2013 Tatsuda ..... B23Q 16/102 188/67
11,566,352 B2 * 1/2023 Myogi ..... D03D 49/02
2010/0183394 A1 * 7/2010 Tatsuda ..... B23Q 16/10 409/183
2012/0011964 A1 * 1/2012 Tatsuda ..... B23Q 16/025 74/813 R
2022/0098766 A1 * 3/2022 Myogi ..... D03D 49/02
2022/0314386 A1 * 10/2022 Ishizaki ..... B23Q 11/121
2022/0356613 A1 * 11/2022 Myogi ..... D03D 49/10

FOREIGN PATENT DOCUMENTS

JP H10-110355 A 4/1998
JP 2004-204418 A 7/2004
WO WO 2017/134644 A1 8/2017

* cited by examiner

LOOM

CROSS-REFERENCE TO RELATED APPLICATION(S)

This application is based on and claims priority under 35 USC 119 from Japanese Patent Application No. 2021-78587 filed on May 6, 2021, the contents of which are incorporated herein by reference.

TECHNICAL FIELD

The present invention relates to a loom including a pair of side frames configured to support a beating device and each having a beam support configured to support a warp beam; and a drive mechanism configured to rotationally drive the warp beam including a beam gear, wherein each of the side frames is configured by a main body frame configured to support the beating device and a let-off frame fixed to the main body frame and configured to support the beam support.

BACKGROUND ART

In a general loom, a frame is configured in a form of connecting a pair of side frames by a plurality of beam members. In addition, as disclosed in PTL 1, each side frame is configured by a main body frame, which is a main part configured to support a beating device and a woven fabric beam, and a let-off frame configured to support a warp beam, and is provided in such a form that the let-off frame is fixed (connected) to the main body frame. Further, a beam support for supporting the warp beam is attached to each let-off frame. The warp beam is supported by the let-off frames via the pair of beam supports, so that the warp beam is supported with respect to the side frames.

Further, the loom includes a drive mechanism for rotationally driving the warp beam. Further, the warp beam includes a beam gear connected to the drive mechanism. In the loom, the warp beam is rotationally driven during weaving by the drive mechanism.

CITATION LIST

Patent Literature

PTL 1: JP2004-204418A

In the meantime, in the loom where the side frame is configured by the main body frame and the let-off frame, as described above, the main body frame is a part configured to support the beating device and the woven fabric beam, as described above, is a part to which an opening device is also mounted, and is a main part of the side frame. Therefore, in the side frame of the general loom, the let-off frame is a small structure, as compared to the main body frame. Further, it is general in the loom that the drive mechanism for rotationally driving the warp beam is provided to the let-off frame configured to support the warp beam.

Note that, in the loom, the side frame vibrates violently during weaving due to vibrations (so-called beating vibrations) associated with a beating operation. Further, in the loom, during weaving, a so-called beam vibration that the warp beam is affected by a tension fluctuation of the warp and therefore vibrates is generated, and the side frame is also affected by the beam vibration.

In this way, the side frame vibrates as a whole during weaving. Further, the let-off frame of the side frame is a small structure, as compared to the main body frame, as described above. For this reason, during weaving, the let-off frame vibrates more violently than the main body frame. Note that, the drive mechanism is generally provided in a form of being attached to the let-off frame, as described above. For this reason, as a result of the let-off frame vibrating violently as described above, the drive mechanism itself also vibrates violently during weaving.

Further, in the drive mechanism, there is a plurality of meshing portions of a gear member, and there is also meshing of the gear member attached to a drive transmission shaft of the drive mechanism and the beam gear of the warp beam between the drive mechanism and the warp beam. When the drive mechanism itself vibrates violently as described above, wear of the gear members is promoted and the gear members are damaged at the meshing portions, so that the drive mechanism may fail.

SUMMARY

It is therefore an object of the present invention to provide a loom where the vibration of the drive mechanism itself, which may cause a failure, is reduced as compared to the related art.

A preamble of the present invention is a loom including a pair of side frames configured to support a beating device and each having a beam support configured to support a warp beam and a drive mechanism configured to rotationally drive the warp beam including a beam gear, wherein each of the side frames is configured by a main body frame configured to support the beating device and a let-off frame fixed to the main body frame and configured to support the beam support.

In order to achieve the above object, the present invention is characterized in that the drive mechanism is attached to the main body frame, in the loom of the preamble.

In addition, in the loom of the present invention, the drive mechanism may include a drive transmission shaft connected to the beam gear via a gear member, and in a case where the drive mechanism is attached to the main body frame in such a form that the drive transmission shaft is inserted in a through-hole formed in the main body frame, the through-hole may be formed as an elongated hole.

In a general loom, the side frame is configured such that the main body frame is a sufficiently large structure, as compared to the let-off frame. Therefore, regarding the vibration generated during weaving, the vibration of the main body frame is sufficiently smaller than the vibration of the let-off frame. In the present invention, the drive mechanism is attached to the main body frame. Therefore, according to the present invention, the vibration of the drive mechanism itself during weaving is sufficiently smaller, as compared to a case where the drive mechanism is attached to the let-off frame. This makes it possible to reduce occurrence of a failure of the drive mechanism and the like caused due to the violent vibration of the drive mechanism itself.

Further, in the general loom, the drive mechanism includes a drive transmission shaft that is rotationally driven by a drive source such as a drive motor. The gear member in mesh with the beam gear is attached to the drive transmission shaft. In addition, the drive mechanism is generally provided in a form of being attached to a wall surface, which faces an outside, of a sidewall of the side frame. Therefore, the side frame is formed with the through-hole for inserting the drive transmission shaft of the drive mechanism, and the drive mechanism is provided in a form of inserting the drive transmission shaft into the through-hole and allowing the gear member to protrude from the sidewall of the side frame.

Note that, the warp beam that is used for the loom is formed to have a dimension in an axis line direction corresponding to a weaving width, but a flange size (flange diameter) is appropriately selected by a user of the loom, considering a production situation and the like. Further, in the warp beam, a diameter of the beam gear is generally set to correspond to the flange diameter. Further, an attaching position of the drive mechanism to the side frame is set so that the gear member meshes with the beam gear at an appropriate position. Therefore, the attaching position is set to a different position for each warp beam having a different flange diameter (a diameter of the beam gear) as described above.

Since the through-hole for inserting the drive transmission shaft as described above is formed at the attaching position on the side frame, the through-hole is formed at a position corresponding to the selected warp beam. In other words, when the flange diameter of the selected warp beam is different, the position of the side frame where the through-hole is formed is different. Therefore, when manufacturing a loom (side frame), it is necessary that the side frame have a through-hole formed at a position corresponding to the flange diameter of the selected warp beam. In addition, a mold is used to manufacture the side frame. For this reason, it is necessary to prepare molds, in which positions of the through-holes are different depending on the flange diameter supposed to be selected, as many as the number of types of supposed warp beams. Making the side frame separately for each warp beam to be selected and preparing the plurality of types of molds will affect the manufacturing cost of the loom (side frame).

In contrast, the through-hole of the side frame, into which the drive transmission shaft is inserted, is formed as an elongated hole, so that a position where the drive transmission shaft is inserted can be arbitrarily set within a range of the elongated hole. That is, the attaching position of the drive mechanism can be arbitrarily set without changing the position of the through-hole itself, which is an elongated hole, and therefore, can be set to a position corresponding to the selected warp beam. Therefore, according to the side frame in which the through-hole is formed in this way, it is possible to cope with a plurality of types of warp beams having different flange diameters, which can reduce the number of molds to be prepared. As a result, the manufacturing cost of the loom (side frame) can be reduced.

DESCRIPTION OF EMBODIMENTS

Figure 1:
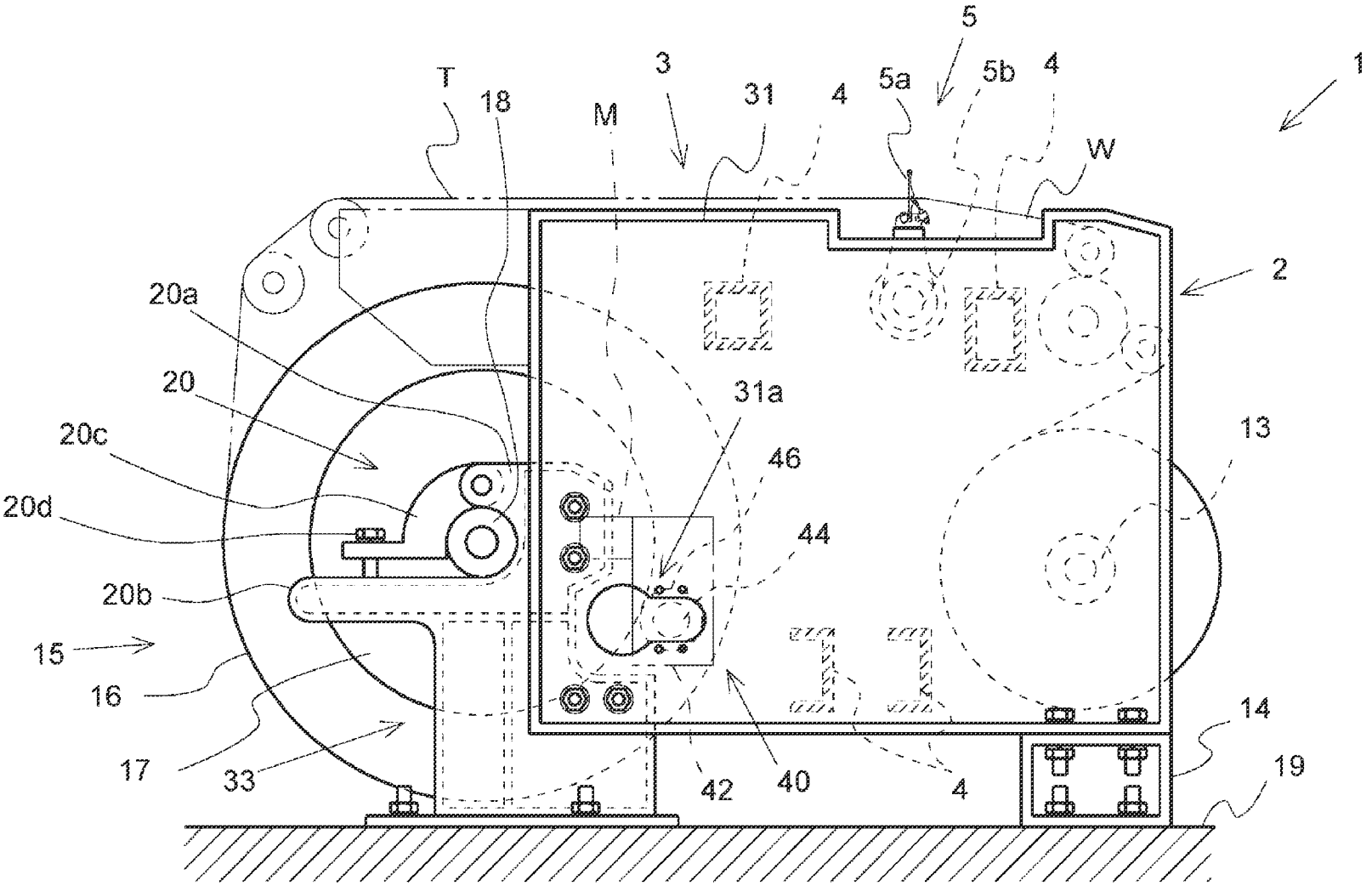
FIG. 1 is a side view of a loom to which the present invention is applied.

Hereinafter, one embodiment of the loom of the present invention will be described with reference to FIGS. 1 to 6.

In a loom 1, a frame 2 has a pair of side frames 3 and 3, as a main body, and both the side frames 3 and 3 are connected in a state of facing each other in a width direction (thickness direction) by a plurality of beam members 3.

The loom 1 also includes a reed 5*a* and a beating device 5 including a mechanism for swinging the reed 5*a*. The beating device 5 includes a locking shaft 5*b* that is driven to reciprocally rotate, a plurality of sley swords attached to the locking shaft 5*b*, and a sley which is supported by each sley sword and to which the reed 5*a* is attached. The locking shaft 5*b* is supported by both the side frames 3 and 3 in a form of being bridged between the pair of side frames 3 and 3, so that the beating device 5 is provided in a form of being supported by the pair of side frames 3 and 3.

The loom 1 also includes a woven fabric beam 13 for winding a woven fabric W woven on a front side in a front-rear direction. As used herein, the front-rear direction is a direction orthogonal to a width direction of the loom 1 (a longitudinal direction of the beam member 4), as seen from above. Shaft portions of both ends of the woven fabric beam 13 are respectively supported by the side frames 3, so that the woven fabric beam 13 is also provided in a form of being supported by the pair of side frames 3 and 3.

The loom 1 also includes a warp beam 15 for delivering a warp T on a rear side in the front-rear direction. Note that, in the loom 1, each side frame 3 is provided with a beam support 20 for supporting the warp beam 15. Shaft portions of both ends of the warp beam 15 are supported by the respective beam supports 20, so that the warp beam 15 is provided in a form of being supported by the pair of side frames 3 and 3 via the pair of beam supports 20 and 20.

In the loom 1 as described above, each side frame 3 has a let-off frame 33, which is a part configured to support the warp beam 15 and formed as a separate body from a main body frame 31 that is a part configured to support the beating device 5 and the woven fabric beam 13. The let-off frame 33 is fixed to the main body frame 31, which is a main body part, thereby forming a part of the side frame 3. That is, each side frame 3 is configured by the main body frame 31, which is a main part and is configured to support the beating device 5 and the woven fabric beam 13, and the let-off frame 33, which is fixed to the main body frame 31 and is configured to support the warp beam 15.

Figure 2:
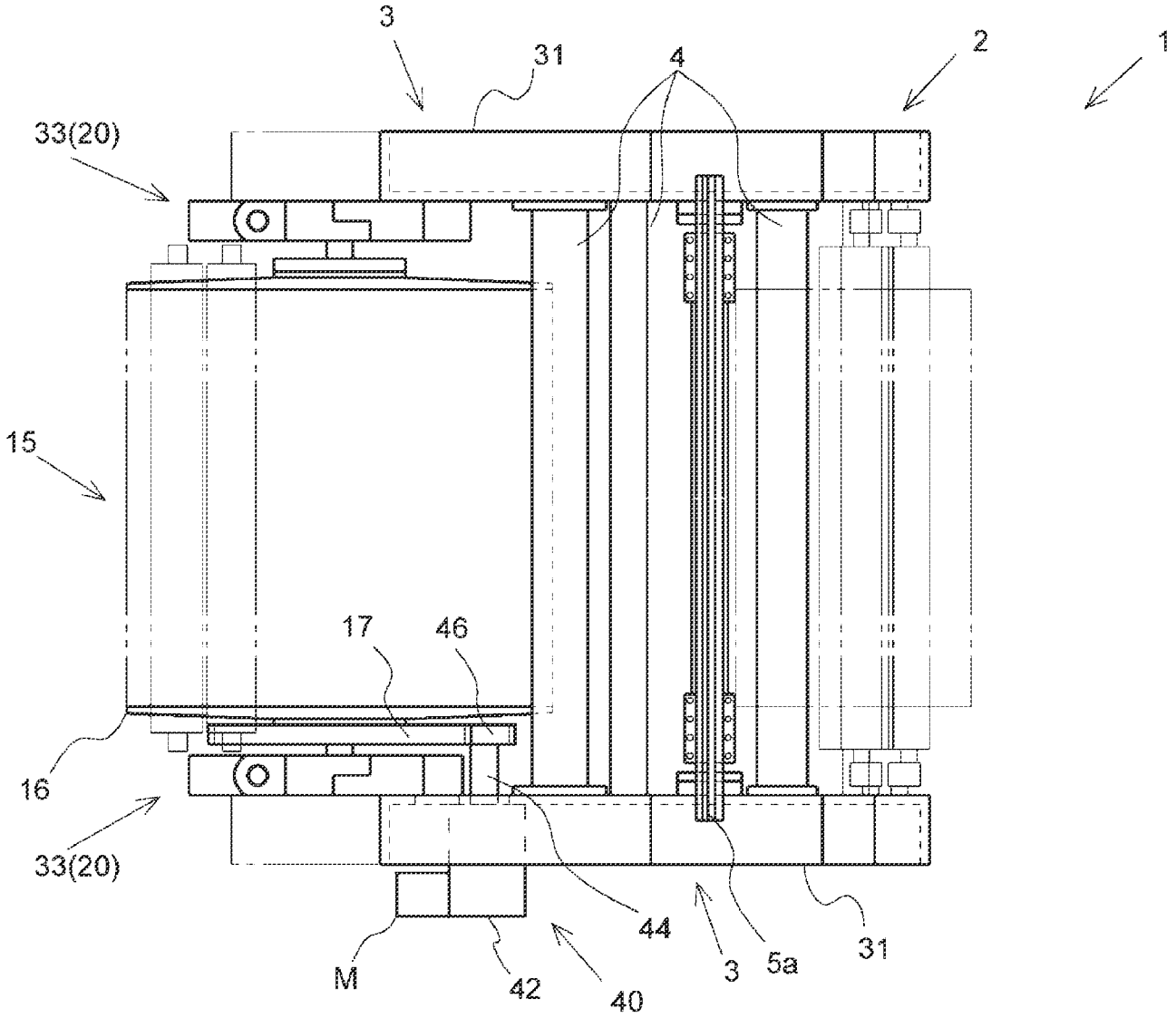
FIG. 2 is a plan view of the loom to which the present invention is applied.

Each side frame 3 is more specifically described. As shown in FIGS. 1 and 2, the main body frame 31 has a housing shape where an outer surface (outer wall) is opened. Both the side frames 3 and 3 are connected at the main body frames 31 by the beam members 4, as described above. For reference, the connecting position is a total of four places of two positions of upper portions and two positions of lower portions of the main body frame 31. However, the upper connecting positions are two positions, i.e., a position spaced forward from a central portion and a position spaced rearward from the central portion in the front-rear direction. In addition, the lower connecting positions are two positions near the central portion.

Further, the main body frame 31 is installed on an installation surface (floor surface) 19 in a weaving factory or the like, but in the shown example, is installed on the installation surface 19 via a raising member 14 for adjusting a height position of the main body frame 31. Note that, the raising member 14 is a block-shaped member having a substantially cuboid shape, and is attached to a lower surface of the main body frame 31 by using a screw member such as a bolt. In addition, the main body frame 31 is installed (fixed) with respect to the installation surface 19 by fixing the raising member 14 to the installation surface 19 by an anchor bolt provided in a form of protruding from the installation surface 19.

In addition, the let-off frame 33 is a part of the side frame 3 configured to support the warp beam 15, and is integrally fixed to the main body frame 31 on a rear part-side of the main body frame 31. However, the warp beam 15 is in a state of being supported by the beam supports 20 on the loom 1, as described above. Therefore, the let-off frame 33 is configured to support the beam support 20. Further, in the loom 1 of the present embodiment, the let-off frame 33 and the beam support 20 are integrally molded, and each is a part of a single delivery structure.

Figure 3:
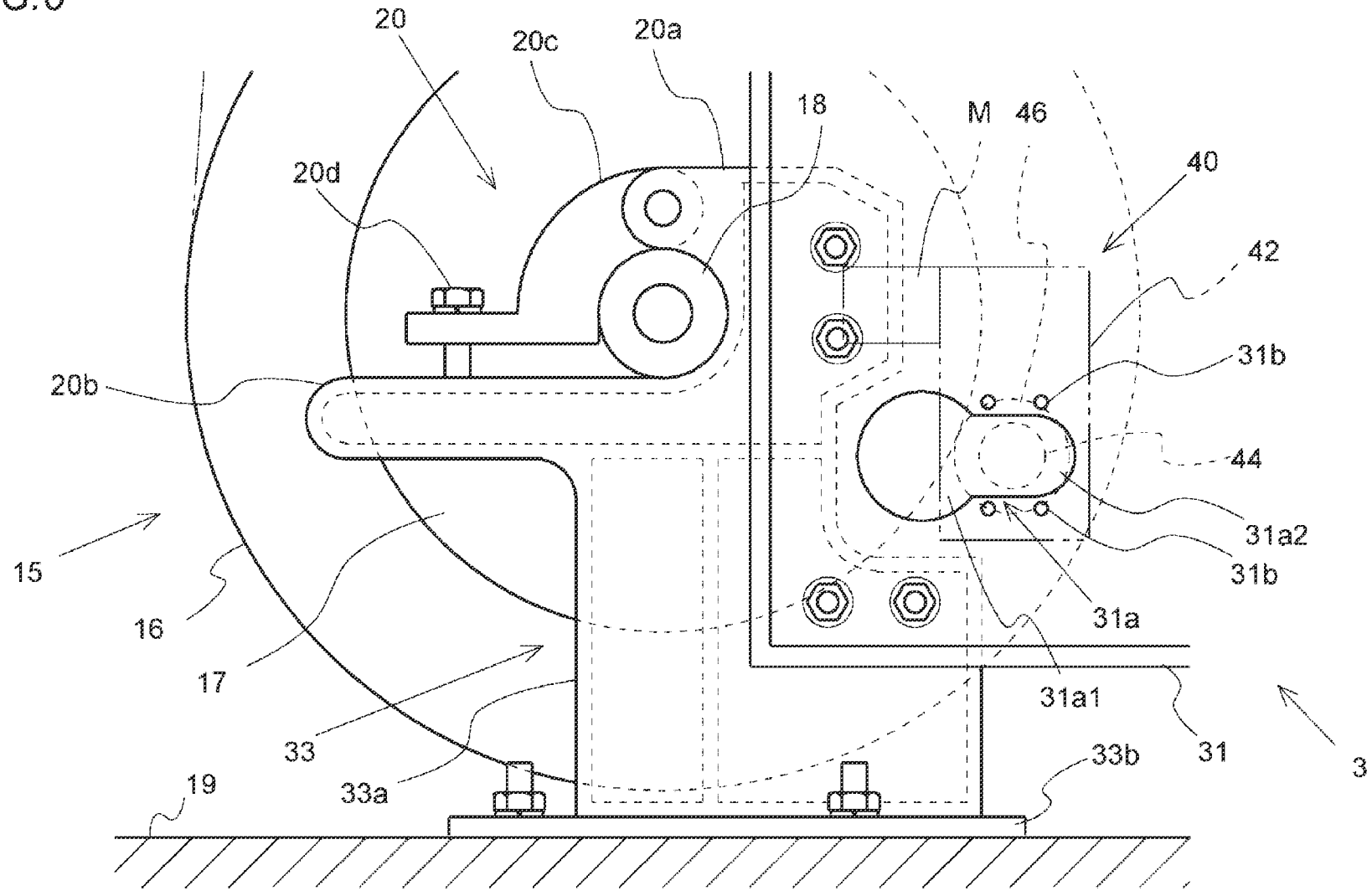
FIG. 3 is an enlarged view of main parts of FIG. 1.

As shown in FIG. 3, a part (let-off frame part) 33 of the delivery structure corresponding to the let-off frame is configured by a base portion 33*b*, which is a portion installed (fixed) on the installation surface 19, and a support portion 33*a* having a substantially housing shape and provided in a form of standing upright on the base portion 33*b*. Note that, in the shown example, the support portion 33*a* is formed such that a side surface facing an inside thereof is opened and a reinforcing rib is formed near a central portion in the front-rear direction. Further, the support portion 33*a* is directly fixed with respect to the installation surface 19 on the base portion 33*b*, but in the fixed state, has such a height dimension that an upper end thereof is located above a lower surface of the main body frame 31 installed on the installation surface 19 via the raising member 14, as described above.

Further, in the delivery structure, a part above the let-off frame part 33 is a part (beam support part) 20 corresponding to the beam support. The beam support part 20 has a support portion 20*a* having an arc-shaped support surface for receiving a bearing 18 fitted to each shaft portion of both ends of the warp beam 15, and a guide portion 20*b* having an upper surface, which is continuous with the support surface so as to guide the warp beam 15, and extending rearward from the support portion 20*a*. In addition, the beam support part 20 has a clamp lever 20*c* for holding the warp beam 15 received by the support portion 20*a*. The clamp lever 20*c* is provided to be rotatable with respect to the support portion 20*a*, and is fixed to the guide portion 20*b* by a fixing means 20*d* such as a bolt so as to hold the warp beam 15 (bearing 18) received by the support portion 20*a*.

The delivery structure is fixed to an inner wall on the rear part-side of the main body frame 31. Specifically, the delivery structure is in a state of being located inside the side frame 3 in such arrangement that the guide portion 20*b* of the beam support part 20 is directed rearward and a part thereof overlaps the main body frame 31 in the front-rear direction. However, a positional relationship between the delivery structure and the main body frame 31 is such that the support surface of the beam support part 20 of the delivery structure is located behind a rear end of the main body frame 31 (the support part does not overlap the main body frame 31). Further, the delivery structure is fixed to the main body frame 31 at a plurality of places by screw members such as bolts, in a state of being in contact with the inner wall of the main body frame 31 on an outer wall of the delivery structure in the above-described positional relationship in the front-rear direction.

Note that, the delivery structure is fixed with respect to the installation surface 19 on the base portion 33*b* of the let-off frame part 33 by an anchor bolt provided in a form of protruding from the installation surface 19, in a state of being fixed to the main body frame 31 as described above.

Figure 4:
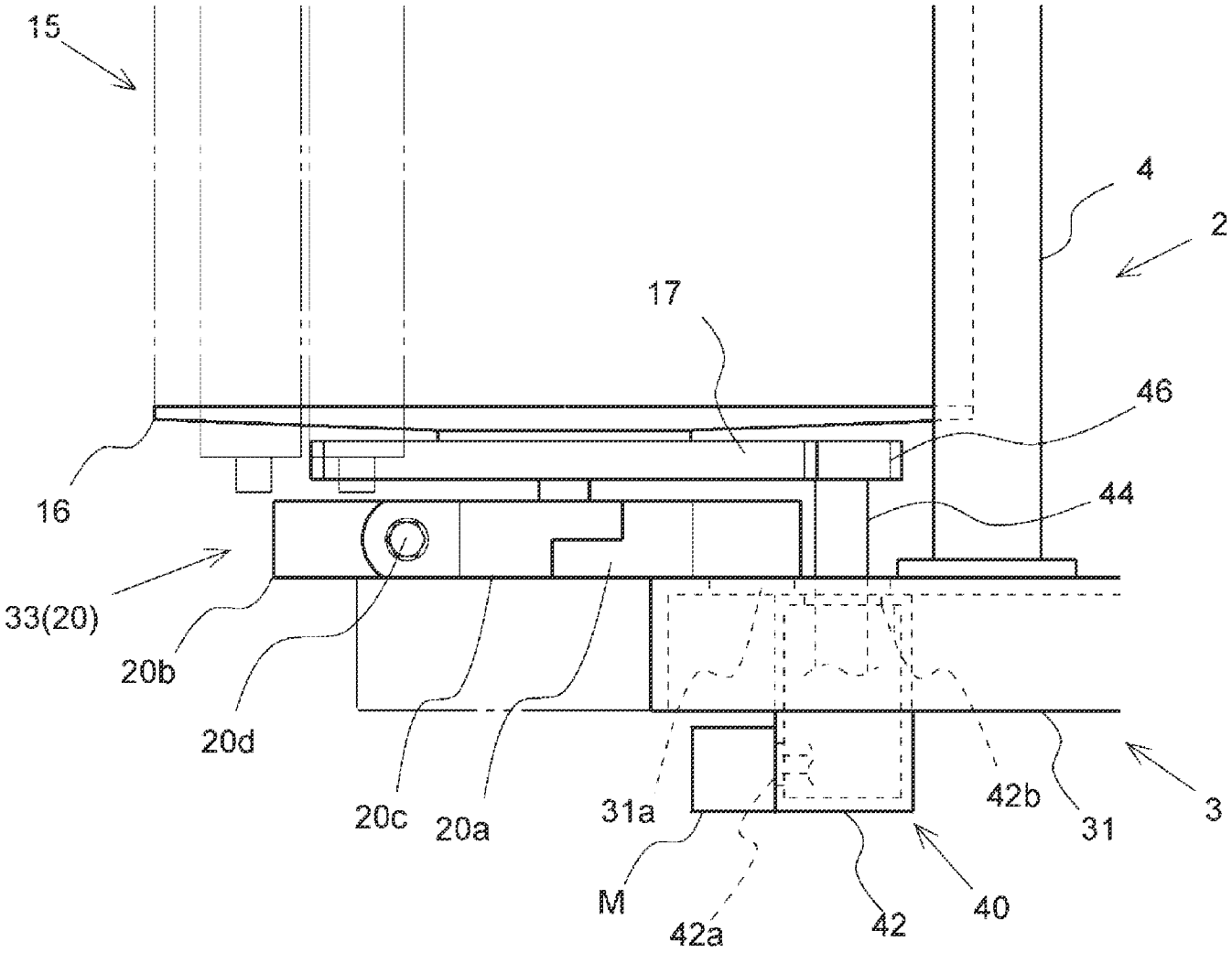
FIG. 4 is an enlarged view of main parts of FIG. 2.

The loom 1 also includes a drive mechanism 40 for rotationally driving the warp beam 15 supported by the beam support part 20 of the delivery structure. More specifically, as shown in FIG. 4, the warp beam 15 includes a beam gear 17 attached to an outer side of a beam flange 16. The drive mechanism 40 includes a delivery motor M as a drive source for rotationally driving the warp beam 15, a drive transmission shaft 44 having one end portion to which a pinion gear 46, which is a gear member in mesh with the beam gear 17 of the warp beam 15, is fixed, and a gearbox 42 in which a gear train for connecting an output shaft of the delivery motor M to the drive transmission shaft 44 is accommodated.

The gearbox 42 of the drive mechanism 40 is formed in a housing shape. In addition, the delivery motor M is attached to the gearbox 42 in a form of being fixed to one of both side surfaces of the gearbox 42. However, the attaching of the delivery motor M is performed in a form of directing the output shaft toward the gearbox 42 and inserting the output shaft into an insertion hole 42*a* formed in the one side surface of the gearbox 42. Further, the gearbox 42 is attached to the side frame 3 in a direction in which both the side surfaces thereof are parallel to a vertical direction and the width direction and the one side surface (the side surface to which the delivery motor M is attached) becomes a rear side.

Further, an end surface (rear end surface), which faces the side frame 3 when attached as described above, of the gearbox 42 is formed with an insertion hole 42*b* having an inner diameter slightly larger than a shaft diameter of the drive transmission shaft 44. The drive transmission shaft 44 is provided in a form of being inserted in the insertion hole 42*b*, an end portion-side on one side to which the pinion gear 46 is fixed as described above protrudes from the gearbox 42, and the drive transmission shaft is supported to be rotatable with respect to the gearbox 42 by a bearing or the like inside the gearbox 42 on an end portion-side on an opposite side. The drive transmission shaft 44 and the output shaft of the delivery motor M are connected by a gear train (not shown) including gears respectively attached to the drive transmission shaft and the output shaft.

Further, the drive mechanism 40 including the delivery motor M and the gearbox 42 is provided in such a form that the gearbox 42 is attached to an outer wall of the side frame 3. Since the gearbox 42 is attached to the outer wall of the side frame 3 in this way, the drive transmission shaft 44 is provided in a form of penetrating the outer wall of the side frame 3. Therefore, the side frame 3 is formed with a through-hole that allows such penetration of the drive transmission shaft 44.

As described above, in the loom, the drive mechanism for rotationally driving the warp beam is provided in a form of being attached to the side frame. in addition, the loom according to the present invention is configured so that the drive mechanism is attached to the main body frame of the side frame. Further, since the drive mechanism 40 is attached to the main body frame 31 in this way, the through-hole through which the drive transmission shaft 44 penetrates is formed in the main body frame 31. In the present embodiment, the through-hole is formed to be an elongated hole. An embodiment (present embodiment) of the loom is described below in detail.

As shown in FIG. 3, the main body frame 31 is formed with a through-hole 31*a*, through which the drive transmission shaft 44 penetrates, at a position overlapping an outer peripheral edge of the beam gear 17 of the warp beam 15 at a lower portion on the rear part-side of the main body frame. The drive mechanism 40 is attached to the main body frame 31 at the gearbox 42 in such a form that the drive transmission shaft 44 penetrates (is inserted in) the through-hole 31*a* as described above. Note that, the attaching position of the gearbox 42 is naturally set to a position where the pinion gear 46 attached to the drive transmission shaft 44 is in a predetermined meshing state with the beam gear 17 of the warp beam 15.

Further, in the present embodiment, the through-hole 31*a* is formed in a key hole shape, and has a round hole portion 31*a*1 having a round hole shape and an elongated hole portion 31*a*2 having an elongated hole shape and formed to be continuous with the round hole portion 31*a*1. Note that, the elongated hole portion 31*a*2 is formed to extend in a direction parallel to the front-rear direction on a front side with respect to the round hole portion 31*a*1. In addition, the elongated hole portion 31*a*2 is formed at a position where a position of a center line thereof substantially coincides with a position of a center of the round hole portion 31*a*1 in the vertical direction.

Further, an inner diameter of the round hole portion 31*a*1 is slightly larger than an outer diameter of the pinion gear 46 fixed to the drive transmission shaft 44. On the other hand, a dimension of the elongated hole portion 31*a*2 in the vertical direction is slightly larger than the shaft diameter of the drive transmission shaft 44. Further, a dimension of the elongated hole portion 31*a*2 in the longitudinal direction is larger than the shaft diameter of the drive transmission shaft 44, and in the shown example, is about 1.5 times as large as the shaft diameter.

In this way, the through-hole 31*a* of the present embodiment has a key hole shape consisting of the round hole portion 31*a*1 having the inner diameter corresponding to the outer diameter of the pinion gear 46 and the elongated hole portion 31*a*2 having the dimension in the vertical direction corresponding to the shaft diameter of the drive transmission shall 44. Thereby, an influence of vibration of the warp beam 15 on the gear train in the gearbox 42 via the drive transmission shaft 44 is suppressed as much as possible.

More specifically, when attaching the drive mechanism 40 to the main body frame 31, the attaching is usually performed in a state where the pinion gear 46 is fixed to the drive transmission shaft 44. Therefore, the through-hole 31*a* is required to have a size that allows the pinion gear 46 to pass through. Therefore, the through-hole 31*a* is formed to have the round hole portion 31*a*1 as described above. When attaching the drive mechanism 40 to the main body frame 31, the pinion gear 46 is caused to pass through the round hole portion 31*a*1 so that the drive transmission shall 44 is inserted in the through-hole 31*a*.

In addition, the through-hole 31*a* has an elongated hole shape as a whole that is long in a direction parallel to the front-rear direction, but is not formed in such a size that the pinion gear 46 is inserted therein over an entire area in the front-rear direction, and a portion excluding the round hole portion 31*a*1 is formed as the elongated hole portion 31*a*2 having the above-described size. Note that, the elongated hole portion 31*a*2 is a portion of the through-hole 31*a* including a position where the drive transmission shaft 44 is inserted with the gearbox 42 being attached to the attaching position. Therefore, a formation position of the round hole portion 31*a*1 in the main body frame 31 is a position other than the position where the drive transmission shaft 44 is inserted in the attached state of the gearbox 42, and in the shown example, is a position that almost overlaps the beam gear 17 of the warp beam 15 in a state of being supported by the beam support part 20.

Note that, in the loom 1, during weaving, a so-called beam vibration that the warp beam 15 is affected by a tension fluctuation of the warp T and therefore vibrates is generated. Such beam vibration is generated for the warp beam 15, so that the drive transmission shaft 44 connected to the warp beam 15 (beam gear 17) via the pinion gear 46 vibrates under the influence of the beam vibration. When the drive transmission shaft 44 vibrates, not only the gear train connecting the drive transmission shaft 44 and the delivery motor M but also the entire gear box 42 supporting the drive transmission shaft 44, the gear train and the like vibrates and the vibration increases, which may cause problems such as wear promotion of the gear train.

Therefore, the gearbox 42 is fixed to the main body frame 31 in the vicinity of the through-hole 31*a* in which the drive transmission shaft 44 is inserted, so as to reduce the vibration as much as possible. Specifically, when fixing the gearbox 42 to the main body frame 31, the fixing position is brought closer to the drive transmission shaft 44, which is a vibration source in the drive mechanism 40, so that the influence of the vibration on the drive transmission shaft 44 can be further increased. Therefore, the fixing position of the gearbox 42 is set in the vicinity of the through-hole 31*a* in which the drive transmission shaft 44 is inserted. That is, the gearbox 42 is fixed to the main body frame 31 at the fixing position set in the vicinity of the through-hole 31*a* in this way. Thereby, the vibration in the drive mechanism 40 can he reduced as much as possible.

In addition, the through-hole 31*a* of the present embodiment is not sized such that the pinion gear 46 can be inserted as a whole, but has a key hole shape as described above, and is formed so that the portion, in which the drive transmission shaft 44 is inserted in the attached state of the gearbox 42, is the elongated hole portion 31*a*2 having the above-described size. According to the through-hole 31*a*, the fixing position of the gearbox 42 can be further brought closer to the drive transmission shaft 44. Therefore, the vibration in the drive mechanism 40 can be further reduced by the setting of the fixing position, so that the occurrence of the above-described problems due to the influence of the vibration can be prevented as much as possible.

Note that, the gearbox 42 is fixed to the main body frame 31 by using screw members such as bolts. Specifically, insertion holes 31*b* for inserting the screw members are formed in the vicinity of an upper edge and a lower edge of the elongated hole portion 31*a*2 of the main body frame 31. On the other hand, a female screw hole (not shown) is formed in a form of corresponding to each insertion hole 31*b* in the vicinity (periphery) of the insertion hole 42*b* of the gearbox 42, in which the drive transmission shaft 44 is inserted. Then, after aligning a position of each insertion hole 31*b* with a position of the female screw hole, the screw member is inserted into the insertion hole 31*b* from a surface, which faces an inside, of the outer wall of the main body frame 31, and the screw member is screwed into the female screw hole of the gearbox 42, so that the gear box 42 is fixed to the main body frame 31.

In addition, as described above, the gearbox 42 is attached to the main body frame 31 at the attaching position where the pinion gear 46 attached to the drive transmission shaft 44 is in a predetermined meshing state with the beam gear 17 of the warp beam 15. Therefore, the attaching position becomes different depending on a diameter of the beam gear 17 of the warp beam 15 (the warp beam 15 selected by a user who uses (purchases) the loom 1) that is supposed to be used for the loom 1. When the attaching position is different, the insertion position of the drive transmission shaft 44 that is inserted in the through-hole 31*a* is also different.

Figure 5:
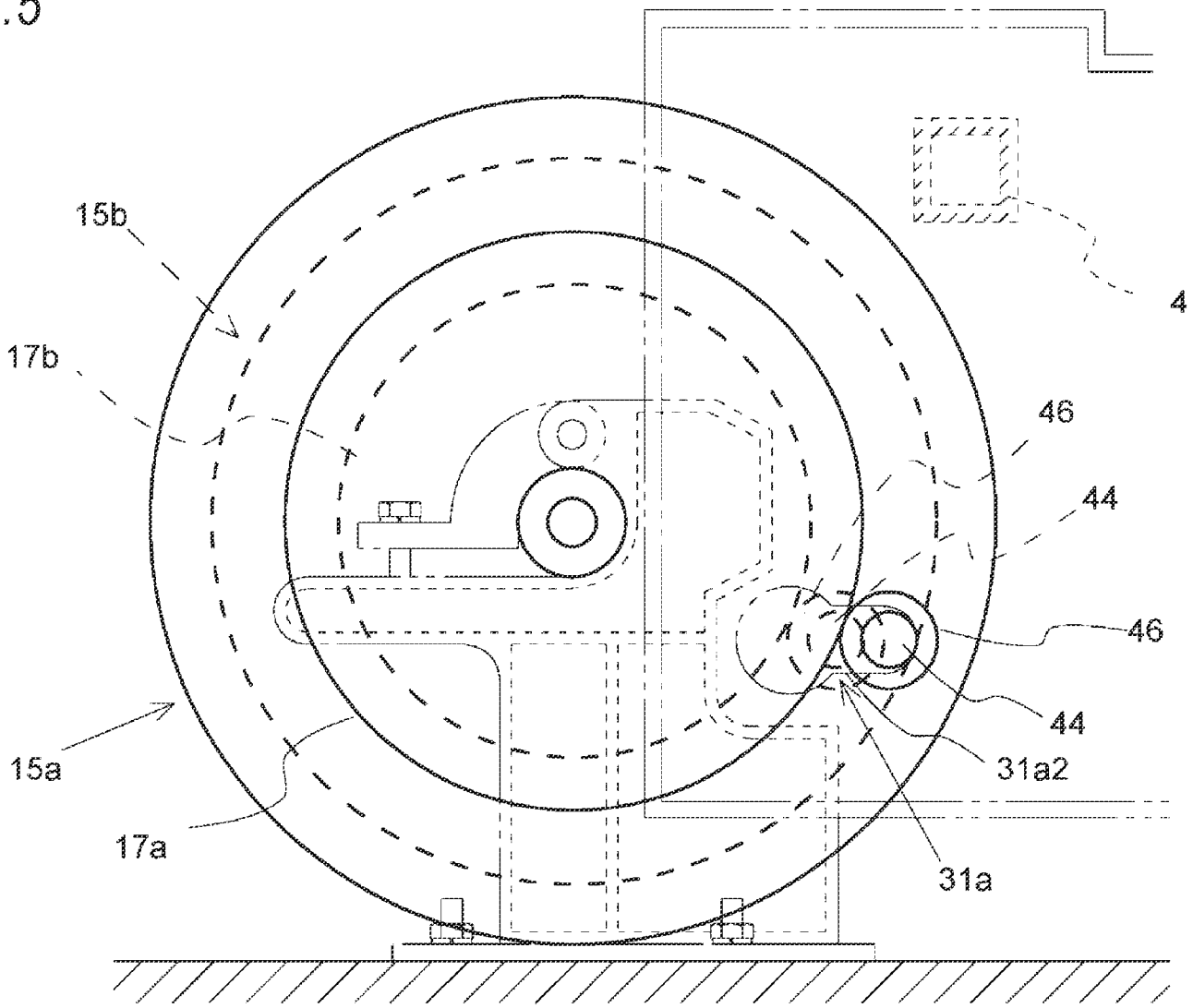
FIG. 5 illustrates a through-hole.

Specifically, as shown in FIG. 5, in a case where diameters of respective beam gears 17*a* and 17*b* are different between a warp beam 15*a* shown by the solid line and a warp beam 15*b* shown by the broken line, the positions of the pinion gear 46 in mesh with the beam gears 17*a* and 17*b* are different, as shown, and the insertion position of the drive transmission shaft 44 into the through-hole 31*a* is accordingly different between cases where the warp beam 15 used for the loom 1 is the warp beam 15*a* and the warp beam 15*b*. Note that, in the shown example, the case where the diameters of the beam gears 17*a* and 17*b* are different between the warp beam 15*a* and the warp beam 15*b* whose beam flanges have different diameters is shown. However, in the loom, even when the diameters of the warp beams (beam flanges) are the same, the diameters of the beam gears may be different. Even in this case, the insertion position of the drive transmission shaft 44 into the through-hole 31*a* is naturally different.

As described above, when the diameter of the beam gear 17 of the warp beam 15 used for the loom 1 is different, the insertion position of the drive transmission shaft 44 into the through-hole 31*a* is accordingly different. Therefore, the elongated hole portion 31*a*2 of the through-hole 31*a*, which is the portion in which the drive transmission shaft 44 is inserted when the gearbox 42 is attached to the main body frame 31 as described above, is formed to have an elongated hole shape as described above, so that even when the through-hole 31*a* formed in the main body frame 31 has the same shape, it is possible to cope with a plurality of types of warp beams having different specifications (diameter of the beam gear).

In addition, the elongated hole portion 31*a*2 of the through-hole 31*a* is formed at a position and to have a size, considering the specification of the warp beam (diameter of the beam gear) supposed to be used for a loom manufactured by using the main body frame 31. Thereby, the main body frame 31 can be used regardless of which of a plurality of types of warp beams having different specifications, which are supposed to be used as described above, is adopted.

Specifically, the through-hole 31*a* is formed such that the elongated hole portion 31*a*2 has a position and a size, including an insertion position of the drive transmission shaft 44 in a case where a warp beam having a beam gear of the smallest diameter of warp beams supposed to be used is used and an insertion position of the drive transmission shall 44 in a case where a warp beam having a beam gear of the largest diameter is used. Note that, the insertion position is a position on a further front side as the diameter of the beam gear is larger (a position on a further rear side as the diameter of the beam gear is smaller). By forming the through-hole 31*a* (elongated hole portion 31*a*2) in this way, the main body frame 31 can be used for all warp beams supposed to be used.

Note that, since the specification of the warp beam, including the diameter of the beam gear, is generally determined before the manufacturing of the loom, which is a time point when the user decides to purchase the loom, the attaching position of the gearbox 42 has been already determined according to the specification of the warp beam (diameter of the beam gear) at a manufacturing stage of the loom. On the other hand, when the through-hole 31*a* (elongated hole portion 31*a*2) of the main body frame 31 is formed as described above, the through-hole in which the drive transmission shaft 44 is inserted is not necessarily required to be a hole corresponding to each specification, during the manufacturing of the main body frame 31, with respect to the specification of the warp beam selected by the user, and it is sufficient to set only the attaching position of the gearbox 42 to a position corresponding to the specification. For reference, the insertion hole 31*b* on the main body frame 31—side in which the screw member is inserted when attaching the gearbox 42 to the main body frame 31 is provided at a position corresponding to the attaching position of the gearbox 42 according to the specification of the warp beam, at the manufacturing stage.

According to the loom 1 of the present embodiment configured as described above, the drive mechanism 40 is attached to the main body frame 31 of the side frame 3. The main body frame 31 is a sufficiently large structure, as compared to the delivery structure including the let-off frame part 33. Therefore, the vibration of the drive mechanism 40 itself during weaving can be made sufficiently smaller than a case where the drive mechanism 40 is attached to the delivery structure (let-off frame part 33). This makes it possible to reduce occurrence of a failure of the drive mechanism 40 and the like caused due to the violent vibration of the drive mechanism 40 itself.

Further, in the loom 1 of the present embodiment, the through-hole 31*a* in which the drive transmission shaft 44 included in the drive mechanism 40 is inserted is formed as an elongated hole. Thereby, the loom 1 can use the main body frame 31 regardless of which of a plurality of types of warp beams having different specifications, which are supposed to be used, is adopted. Therefore, when manufacturing the loom 1 (main body frame 31), it is not necessary to make the main body frame 31 separately for each specification of the warp beam (diameter of the beam gear), so that the manufacturing cost of the loom 1 (main body frame 31) can be reduced.

Further, in the loom 1 of the present embodiment, the through-hole 31*a* in which the drive transmission shaft 44 is inserted has a key hole shape consisting of the round hole portion 31*a*1 having the inner diameter corresponding to the outer diameter of the pinion gear 46 and the elongated hole portion 31*a*2 having the dimension in the vertical direction corresponding to the shaft diameter of the drive transmission shaft 44. Thereby, the fixing position of the gearbox 42 can be brought closer to the drive transmission shaft 44 than a case where the through-hole 31*a* is formed as an elongated hole as a whole having a size that allows the pinion gear 46 to be inserted. As a result, it is possible to further reduce the vibration in the drive mechanism 40 caused due to the beam vibration, so that the occurrence of the problems such as wear promotion of the gear train in the gearbox 42 due to the influence of the vibration can be prevented as much as possible.

Note that, the present invention is not limited to the above-described embodiment (the above embodiment), and can also be implemented in following modified embodiments.

(1) As for the through-hole formed in the main body frame, in which the drive transmission shaft is inserted, in the above embodiment, the through-hole 31*a* is formed to have an elongated hole at a portion (shaft arranging portion) that is arranged at the drive transmission shaft 44 in a state where the gearbox 42 is attached to the main body frame, so as to commonly use the main body frame 31 with respect to the specifications (diameter of the beam gear) of a plurality of warp beams supposed to be used. In addition, considering the vibration of the drive mechanism 40, the through-hole 31*a* is formed as a hole having a portion (gear passing portion) that is used only for allowing the pinion gear 46 to pass through when attaching the gearbox 42 to the main body frame 31, in addition to the shaft arranging portion, so as to make a size of the shaft arranging portion close to the shaft diameter of the drive transmission shaft 44 (so as to bring the attaching position of the gearbox 42 close to the drive transmission shaft 44). As a result, the through-hole

31*a* is formed to have a key hole shape. However, the through-hole in which the drive transmission shaft is inserted is not limited to such a shape.

For example, in a case where the influence of the beam vibration on the gear train in the gearbox is small, or the like, the fixing position of the gearbox to the main body frame can be set to a position apart from the drive transmission shaft. Therefore, in this case, the through-hole may be formed to have such a size that the shaft arranging portion can allow the pinion gear to pass through. In this case, since the gear passing portion (a dedicated portion for passing of the pinion gear) is not required, the through-hole is formed only by the shaft arranging portion.

Further, in the embodiment, the shaft arranging portion is formed to be an elongated hole, as described above, and is also formed so that the longitudinal direction thereof is parallel to the front-rear direction. However, in the case where the shaft arranging portion of the through-hole is formed as an elongated hole, the longitudinal direction of the shaft arranging portion is not limited to the direction parallel to the front-rear direction, and may also be the vertical direction or a direction (oblique direction) forming an angle with respect to the vertical direction and a direction parallel to the front-rear direction. That is, depending on the specifications of the plurality of warp beams supposed to be used, it cannot be said that the insertion positions of the drive transmission shaft to the main body frame (at the position where the beam gear and the pinion gear are in a predetermined meshing state) with respect to each specification are aligned in the direction parallel to the front-rear direction. Therefore, the longitudinal direction of the shaft arranging portion is preferably a direction corresponding to the direction in which the insertion positions are aligned. In addition, since the direction in which the insertion positions are aligned is not limited to a linear direction, it is also considered that the shaft arranging portion has a curved shape.

In the example described above, as described above, in order to make the main body frame common to the specifications of the plurality of warp beams supposed to be used, the through-hole is formed so that the shaft arranging portion is an elongated hole. However, in the present invention, the through-hole is not limited to the one where the shaft arranging portion is formed as an elongated hole. For example, in a case where the specification of the warp beam supposed to be used for the loom to be manufactured or in a case where it is not a problem to form a through-hole when the specification of the warp beam (diameter of the beam gear) is different for each type, the through-hole may be formed so that the shaft arranging portion has a (mere) round hole shape.

In a case where the shaft arranging portion is formed as a mere round hole, a hole diameter thereof may be set to a size close to the shaft diameter of the drive transmission shaft, and the through-hole may be formed as a hole having the shaft arranging portion and the gear passing portion. Alternatively, the hole diameter of the shaft arranging portion may be set to a size that allows the pinion gear to pass through, and the through-hole may be formed only by the round hole-shaped shaft arranging portion.

(2) As for the loom that is the preamble, in the above embodiment, the side frame 3 is configured such that the let-off frame and the beam support are integrally formed as a delivery structure. However, the side frame of the loom that is the preamble of the present invention is not limited to such a configuration, and may also be configured such that the let-off frame and the beam support are formed as separate bodies. Note that, in this case, the side frame is provided in such a form that the beam support is supported with respect to the let-off frame, and is configured so that the let-off frame is fixed to the main body frame.

Further, in the above embodiment, the let-off frame (delivery structure) is provided in a form of being fixed to the inner wall of the main body frame 31. However, the let-off frame of the side frame of the loom that is the preamble of the present invention is not limited to such a configuration where it is provided on the inner wall. For example, the let-off frame may also be provided in a form of being fixed to the rear end surface of the main body frame.

Figure 6:
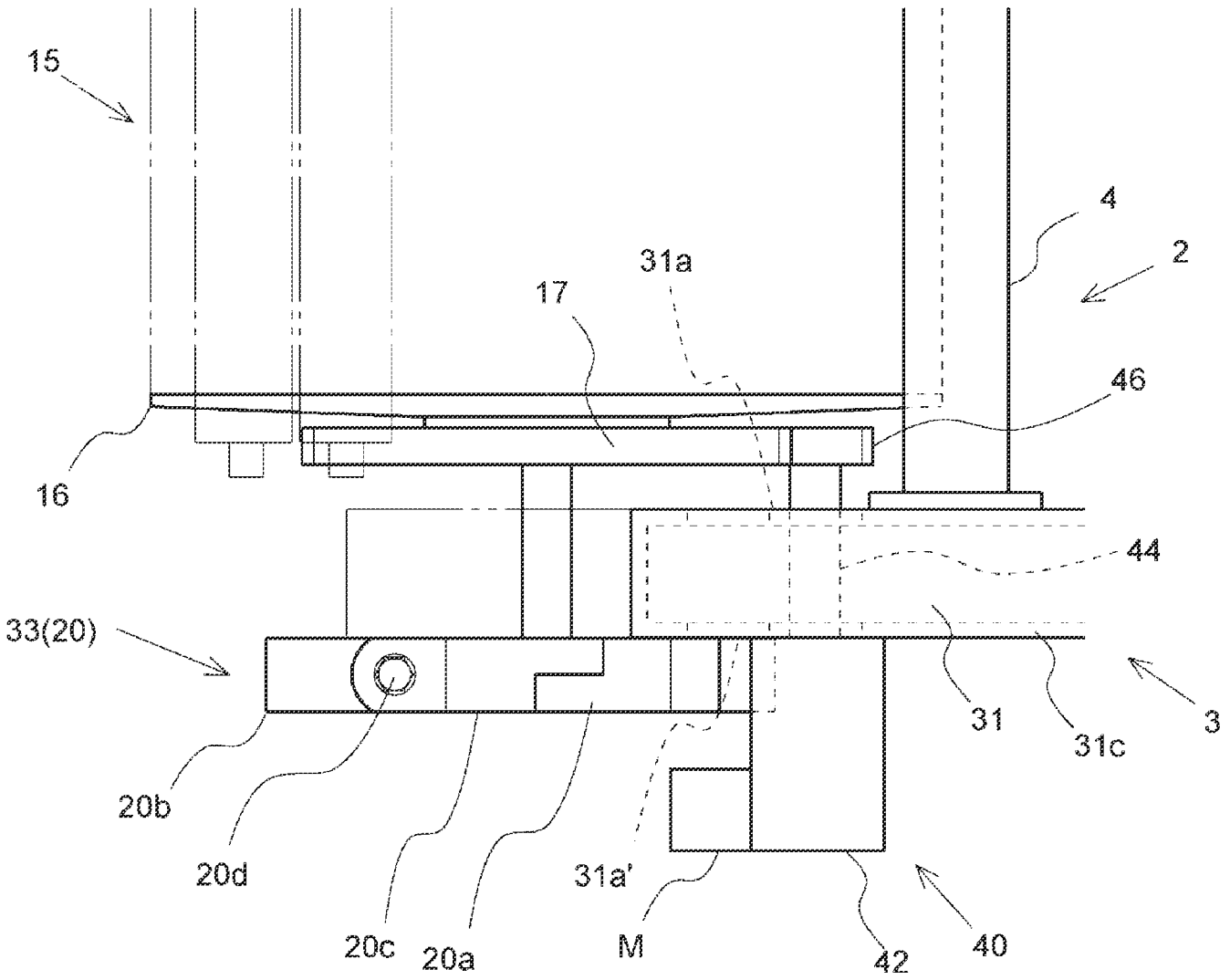
FIG. 6 is a plan view of another loom to which the present invention is applied.

Further, in the above embodiment, the main body frame 31 does not have an outer wall. However, in a case where the main body frame has an outer wall, the let-off frame may be provided in a form of being fixed to the outer wall of the main body frame. Specifically, in the above embodiment, the main body frame 31 has a housing shape where an outer surface (outer wall) is opened, i.e., the main body frame 31 does not have an outer wall. However, as shown in FIG. 6, in a case where the main body frame 31 has a housing shape having an outer wall 31*c*, the let-off frame (let-off frame part 33) may be provided in a form of being fixed to the outer wall 31*c*.

Note that, in this case, the outer wall 31*c* is formed with a through-hole 31*a*' having the same shape and size as the through-hole 31*a*, in which the drive transmission shaft 44 is inserted, at a position facing the through-hole 31*a* in the width direction. Further, the gearbox 42 of the drive mechanism 40 is fixed to the outer wall 31*c* in a state where the drive transmission shaft 44 is inserted in the through-hole 31*a*' and the through-hole 31*a*.

(3) Further, in the above embodiment, in the drive mechanism 40 for rotationally driving the warp beam 15 (beam gear 17) of the loom 1, the drive transmission shaft 44 and the output shaft of the delivery motor M are connected by the gear train including the gears attached to each of the drive transmission shaft and the output shaft. However, in the loom that is the preamble of the present invention, the drive mechanism for rotationally driving the warp beam (beam gear) may be configured such that the gear attached to the output shaft of the delivery motor and the gear attached to an end of the drive transmission shaft on an opposite side to the pinion gear are connected by a belt member.

Note that, the present invention is not limited to the above-described example, and can be appropriately changed without departing from the gist of the present invention.

The invention claimed is:

1. A loom comprising:

a pair of side frames configured to support a beating device and each having a beam support configured to support a warp beam; and a drive mechanism configured to rotationally drive the warp beam including a beam gear, each of the side frames being configured by:

a main body frame, configured to support the beating device, and provided in the form of being directly fixed with respect to a floor surface; and a let-off frame formed as a separate body from the main body frame, the let-off frame being:

configured to support the beam support;

fixed to the main body frame; and installed in the form of being installed on a floor surface and directly fixed with respect to the floor surface, wherein the drive mechanism comprises a drive transmission shaft connected to the beam gear via a gear member, and is attached to the main body frame in such a form that the drive transmission shaft is inserted in a through-hole formed in the main body frame, and wherein the through-hole is formed as an elongated hole elongated in any one of a front-rear direction, a vertical direction, and a direction forming an angle with respect to the vertical direction and the front-rear direction of the loom.

* * * * *